United States Patent [19]

Kasperkovitz et al.

[11] Patent Number: 4,587,478

[45] Date of Patent: May 6, 1986

[54] TEMPERATURE-COMPENSATED CURRENT SOURCE HAVING CURRENT AND VOLTAGE STABILIZING CIRCUITS

[75] Inventors: Wolfdietrich G. Kasperkovitz; Dirk J. Dullemond, both of Eindhoven, Netherlands

[73] Assignee: U.S. Philips Corporation, New York, N.Y.

[21] Appl. No.: 589,244

[22] Filed: Mar. 13, 1984

[30] Foreign Application Priority Data

Mar. 31, 1983 [NL] Netherlands ..... 8301138

[51] Int. Cl.[4] ..... G05F 1/46

[52] U.S. Cl. ..... 323/316; 307/296 R; 307/310; 323/907

[58] Field of Search ..... 323/312, 313, 314, 315, 323/316, 907; 307/296 R, 297, 310, 491, 496; 330/256

[56] References Cited

U.S. PATENT DOCUMENTS

| | | | |
|---|---|---|---|
| 3,914,683 | 10/1975 | van de Plassche | 323/316 |
| 4,150,309 | 4/1979 | Tokuda | 323/312 |
| 4,282,477 | 8/1981 | Ahmed | 323/312 |
| 4,443,753 | 4/1984 | McGlinchey | 323/313 |

*Primary Examiner*—Patrick R. Salce
*Assistant Examiner*—D. L. Rebsch
*Attorney, Agent, or Firm*—Robert T. Mayer; Steven R. Biren

[57] ABSTRACT

A transconductance amplifier includes a differential amplifier, whose collector load is a current mirror having a current output. A current-source transistor arranged in the common emitter line supplies a current having a positive temperature-dependence. This current is obtained from a current-stabilizing circuit. By means of a voltage divider a fraction of a temperature-independent voltage is applied between the control electrodes of the differential amplifier, which voltage is taken from a voltage-stabilizing circuit. Depending on the value of this fraction, the output current is temperature-independent or has a negative temperature-dependence.

3 Claims, 4 Drawing Figures

TEMPERATURE-COMPENSATED CURRENT SOURCE HAVING CURRENT AND VOLTAGE STABILIZING CIRCUITS

BACKGROUND OF THE INVENTION

The invention relates to a current-source arrangement for generating a current which is substantially temperature-independent or has a negative temperature-dependence, which arrangement comprises a current-stabilizing circuit for generating a current having a positive temperature-dependence.

Such a current-stabilizing arrangement is disclosed in U.S. Pat. No. 3,914,683. The arrangement comprises two parallel circuits between a first and a second common terminal. The first circuit comprises a first resistor, a first transistor and a second resistor and the second circuit comprises a second transistor and a third resistor. The first and the second transistor have common control electrodes which are driven by a differential amplifier whose control electrodes are connected to a point between the first transistor and the second resistor and a point between the second transistor and the third resistor.

The output current of such a current stabilizer is proportional to the ratio between the absolute temperature and the resistance of the first resistor. In accordance with the above-mentioned Patent this output current may be used for deriving a temperature-independent current or voltage, or a current or voltage with a positive or a negative temperature-coefficient.

A current with a positive temperature dependence is required, for example, in an integrated FM receiver as described in the non-prepublished European Patent Application No. 83200281. In such a receiver, low-pass filters are employed for tuning and for frequency-to-phase converters for, inter alia, demodulation. In order to ensure operation over a wide temperature range, the receiver should meet stringent requirements. In order to minimize the effect of temperature variations it is necessary to employ temperature-compensated transconductance filters in the tuning section and, if delay elements are employed in the frequency-to-phase converters, temperature-compensated delay elements. Such delay elements are the subject of U.S. patent application Ser. No. 590,095 filed simultaneously with the present Application.

A stabilized current which is directly proportional to the temperature of the integrated circuit is required for the temperature compensation of the transconductance filters. Such a current can be generated with the current-stabilizing arrangement described in said United States Patent, the first resistor being externally added to the integrated circuit so as to prevent the temperature dependence from being influenced.

Both a temperature-independent voltage and a temperature-independent current are needed for the temperature compensation of the delay elements. A temperature-independent voltage can be obtained by means of a fully integrated current stabilizer in accordance with said United States Patent. However, the known current-stabilizing arrangement can supply a temperature-independent current only if an external resistor is added to the integrated circuit.

The temperature compensation of both the transconductance filters and the delay elements then requires the use of two current-stabilizing arrangements each with an externally added resistor and hence two connection pins on the integrated circuit. This entails additional costs and makes it more difficult to obtain an integrated FM receiver of the desired small dimensions.

SUMMARY OF THE INVENTION

Therefore, it is an object of the invention to provide a circuit arrangement for generating a temperature-independent current or a current with a negative temperature-dependence, which is based on a current-stabilizing circuit supplying a current with a positive temperature-dependence, without the use of additional external elements and connection pins on the integrated circuit.

A current-source arrangement of the type set forth above is characterized in that the arrangement further comprises a voltage-stabilizing circuit for generating a temperature-independent voltage and an amplifier having a current output, which amplifier comprises two transistors arranged as a differential pair, a current having a positive temperature-dependence derived from the current stabilizer being applied to the common emitter connection of said transistors and at least a fraction of the output voltage of the voltage-stabilizing circuit being applied between the bases of the two transistors.

The invention is based on a recognition of the fact that it is possible to derive a temperature-independent current and a current having a negative temperature-dependence from a temperature-dependent current and a temperature-independent voltage by means of a differential amplifier. The temperature-dependent current then constitutes the tail current of the amplifier and a fraction of the temperature-independent voltage is applied to the control inputs of the amplifier. For comparatively low input voltages the output current is found to be substantially temperature-independent over a wide temperature range. For higher input voltages the output current has a negative temperature-dependence. The voltage stabilizer and the amplifier can be fully integrated without the addition of external components, so that the external resistor for the current stabilizer need be the only external component.

Since the temperature-independent input voltages of the amplifier must be comparatively small in order to obtain a satisfactory temperature-independence of the output current, the offset voltage of the amplifier should be small or be compensated for as far as possible. The influence of the offset voltage of the amplifier may be reduced by providing the two transistors of the amplifier with a plurality of emitters.

Alternatively, or in addition, the influence of the offset voltage may be reduced by establishing that the fraction of the output voltage of the voltage-stabilizing circuit has such a magnitude that the output current of the amplifier has a negative temperature-dependence and that such a fraction of a current having a positive temperature-dependence, derived from the current-stabilizing circuit, is added to said output current that the sum of said currents is substantially temperature-independent. Increasing the input voltage of the amplifier leads to an output current which decreases as a substantially linear function of the temperature. This temperature-dependence can be compensated for by a fraction of the output current of the current-stabilizing circuit which current increases as a substantially linear function of the temperature.

The arrangement may be further characterized in that the current-stabilizing circuit and the voltage-stabilizing circuit each comprise a first and a second parallel circuit between a first and a second common terminal, which first circuit comprises the series arrangement of a first resistor, the emitter-collector path of a first transistor and a second resistor in that order, which second circuit comprises the series arrangement of the emitter-collector path of a second transistor, whose control electrode is connected in common with that of the first transistor, and a third resistor, which second and third resistors are connected to the second common terminal which, by means of a third transistor arranged as an emitter follower, is driven by the output of a differential amplifier comprising a fourth and a fifth transistor which are arranged as a differential pair and whose control electrodes are connected to a point between the second resistor and the first transistor and to a point between the third resistor and the second transistor respectively, the common connection of the emitters of the fourth and the fifth transistor being coupled to the common control electrodes of the first and the second transistor. The voltage stabilizer is now of the same circuit design as the current stabilizer. The output current of the current stabilizer can be taken from, for example, the collector of a transistor whose base-emitter path is arranged in parallel with the base-emitter path of the first transistor. The output voltage of the voltage stabilizer can be taken from the second common terminal.

BRIEF DESCRIPTION OF THE DRAWING

The invention will now be described in more detail, by way of example, with reference to the accompanying drawing, in which.

DESCRIPTION OF THE PREFERRED EMBODIMENTS

Figure 1:
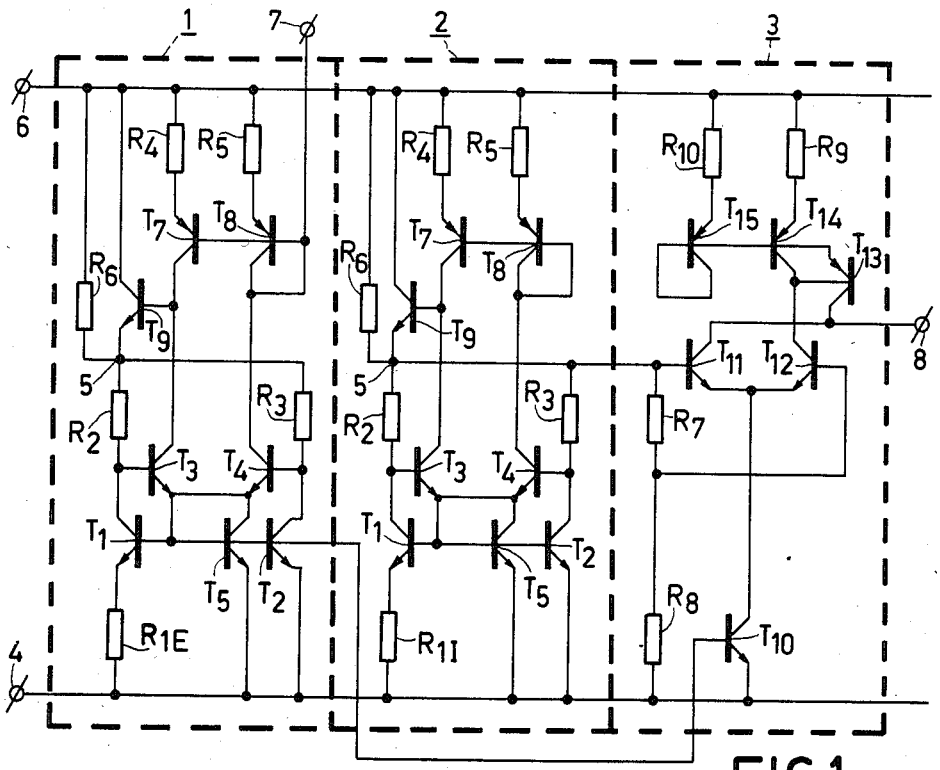
FIG. 1 shows a first embodiment of the invention.

FIG. 1 shows a first current-source arrangement in accordance with the invention. Such an arrangement may for example form part of an integrated FM receiver, in which both a temperature-dependent and a temperature-independent current and a temperature-independent voltage are required. The arrangement comprises a current-stabilizing circuit 1, a voltage-stabilizing circuit 2 and an amplifier 3. The voltage stabilizer 2 is of the same circuit design as the current stabilizer 1. Identical parts of the current and voltage stabilizers bear the same reference numerals. The current-stabilizing circuit 1 and the voltage-stabilizing circuit 2 are each known per se from U.S. Pat. No. 3,914,683. The current-stabilizing circuit 1 comprises two parallel circuits between a first common terminal 4, which is the negative power-supply terminal $-V_B$, and a second common terminal 5. The first circuit comprises a first resistor $R_{1E}$, the collector-emitter path of a first transistor $T_1$, and a second resistor $R_2$. The second circuit comprises a second transistor $T_2$ and a third resistor $R_3$. The base of transistor $T_2$ is connected to the base of transistor $T_1$. In the present embodiment the resistors $R_2$ and $R_3$ are identical so that equal currents will flow in both circuits. The emitter area of transistor $T_1$ must in such a case be larger than that of transistor $T_2$. In the present embodiment the emitter area of transistor $T_1$ is four times as large as that of transistor $T_2$. Instead of identical resistors $R_2$ and $R_3$ it is apparent that unequal resistors may be selected in order to achieve a current ratio different from unity in the two circuits of the current stabilizer. The current ratio can be defined accurately because accurate ratios between the values of the resistors $R_2$ and $R_3$ can be achieved when these resistors are integrated. Equal currents in both circuits are obtained by means of a differential amplifier. This amplifier comprises two transistors $T_3$, $T_4$, whose emitters are connected to the common control electrodes of the transistors $T_1$ and $T_2$ and, via a common transistor $T_5$ arranged as a diode, to the negative power-supply terminal 4. The emitter area of transistor $T_5$ is twice as large as that of transistor $T_2$. The control electrode of the transistor $T_3$ is connected to the collector of transistor $T_1$ and the control electrode of the transistor $T_4$ is connected to the collector of transistor $T_2$. In the present embodiment the collectors of the transistors $T_3$ and $T_4$ are loaded by a current mirror comprising two PNP transistors $T_7$ and $T_8$, transistor $T_8$ being arranged as a diode and the emitters of these transistors being connected to the positive power-supply terminal 6 via resistors $R_4$ and $R_5$. The output signal of the differential amplifier is taken from the collector of transistor $T_7$ and applied to the base of the emitter-follower transistor $T_9$, whose emitter is connected to the second common terminal 5 of the first and the second circuit. A resistor $R_6$ is arranged in parallel with the collector-emitter path of the transistor $T_9$, which resistor functions as a starting resistor for starting the current stabilizing circuit.

As a result of the high gain of the differential amplifier, the voltages on the bases of transistors $T_3$, $T_4$ and consequently the voltages across the resistors $R_2$ and $R_3$ are equal, so that in the case of equal resistors $R_3$ and $R_2$, equal currents will flow in the first and the second circuit. Since the voltages on the bases of the transistors $T_3$ and $T_4$ are equal, the collector-base voltages of the transistors $T_1$ and $T_2$ are also equal, which last-mentioned voltages remain highly constant in the case of supply-voltage variations because the common control electrodes of the transistors $T_1$ and $T_2$ are coupled to the common-mode point of the differential amplifier $T_3$, $T_4$. As set forth in U.S. Pat. No. 3,914,683, the current in the two circuits in the case of equal resistors $R_3$, $R_2$ is $$I = \frac{kT}{qR_{1E}} \ln n,$$

where k is Boltzmann's constant, T the absolute temperature, n the ratio between the emitter areas, and q the electron charge. It is apparent that if the current I must be directly proportional to the temperature of the integrated circuit, the resistor $R_{1E}$ must be temperature-independent. Therefore, the resistor $R_{1E}$ is added externally to the integrated circuit. A temperature-dependent output current can be taken from, for example, the collectors of transistors whose base-emitter paths are arranged in parallel with the base-emitter path of transistor $T_1$. This is the case for transistor $T_{10}$, which forms part of the amplifier 3. A temperature-dependent current can also be taken from the collector of transistor $T_9$, but in the present example this transistor is connected to the positive power-supply terminal 6. Alternatively, a temperature-dependent current may be taken from the collector of a transistor whose base-emitter path is arranged in parallel with the base-emitter path of transistor $T_8$. Since in the present example the emitter area of transistor $T_5$ is twice as large as that of transistor $T_2$ the stabilized current I will also flow in the collector circuits of the transistors $T_3$, $T_4$. If the circuit forms part of an integrated FM receiver the temperature-dependent currents may be applied to the transconductance filters employed for tuning.

The voltage stabilizer 2 is constructed in the same way as the stabilizer 1, except that in the first circuit the external resistor $R_{1E}$ has been replaced by an integrated resistor $R_{1I}$. The voltage on the second common terminal 5 of the first and the second circuit depends on a voltage having a positive temperature-dependence, which is produced across a resistor (for example $R_3$ in the second circuit) by the current I having a positive temperature-dependence, and on two base-emitter voltages having a negative temperature-dependence ($T_2$ and $T_4$ in the second circuit). By a correct choice of the magnitude of the current I and the magnitudes of the resistors $R_2$ and $R_3$ a temperature-independent voltage of approximately $2E_{gap}$ can be taken from the common terminal 5, $E_{gap}$ being the band gap of the semiconductor material used. In this case the resistor $R_{1I}$ may be integrated because the temperature-independent voltage is determined by $R_2$ and $R_3$.

The amplifier 3 comprises the transistors $T_{11}$, $T_{12}$, arranged as a differential pair, whose emitters are connected to the collector of transistor $T_{10}$. The base-emitter junction of transistor $T_{10}$ is connected in parallel with the base-emitter junction of transistor $T_2$ of the current stabilizing circuit 1, so that the collector current of transistor $T_{10}$ has a positive temperature-dependence. The collectors of the transistors $T_{11}$ and $T_{12}$ are loaded by a current-mirror comprising the transistors $T_{13}$, $T_{14}$ and $T_{15}$, the emitters of the transistors $T_{14}$ and $T_{15}$ being connected to the positive power-supply terminal 6 via identical resistors $R_9$ and $R_{10}$. The output current of the amplifier, which current is formed by the difference between the collector currents of the transistors $T_{11}$ and $T_{12}$, is available on terminal 8, which is connected to the collector of transistor $T_{13}$. By means of a voltage divider comprising the integrated resistors $R_7$ and $R_8$ a fraction of the output voltage of the voltage stabilizer 2 is applied between the base electrodes of transistors $T_{11}$ and $T_{12}$. For comparatively small values of the input voltage $V_{in}$ the output current $I_{out}$ of the amplifier 3 is substantially independent of the temperature. The variations of the collector currents $I_1$ and $I_2$ of the transistors $T_{11}$ and $T_{12}$ respectively in the case of variations of the corresponding base-emitter voltages $V_{BE1}$ and $V_{BE2}$ are approximately:

$$\Delta I_1 = \frac{q}{kT} \cdot \frac{I}{2} \Delta V_{BE1} \text{ and } \Delta I_2 = \frac{q}{kT} \cdot \frac{I}{2} \Delta V_{BE2}$$

where I is the transistor $T_{10}$ collector current having a positive temperature-dependence. It follows that when $V_{in} = \Delta V_{BE1} - \Delta V_{BE2}$ the output current $$I_u = \Delta I_1 - \Delta I_2 = \frac{q}{kT} \cdot \frac{I}{2} V_{in}.$$

Since the voltage $V_{in}$ is a fraction of the temperature-independent output voltage of the voltage-stabilizing circuit 2 and the current I has a positive temperature-dependence, it will be appreciated that the output current $I_u$ is substantially temperature-independent.

Figure 2:
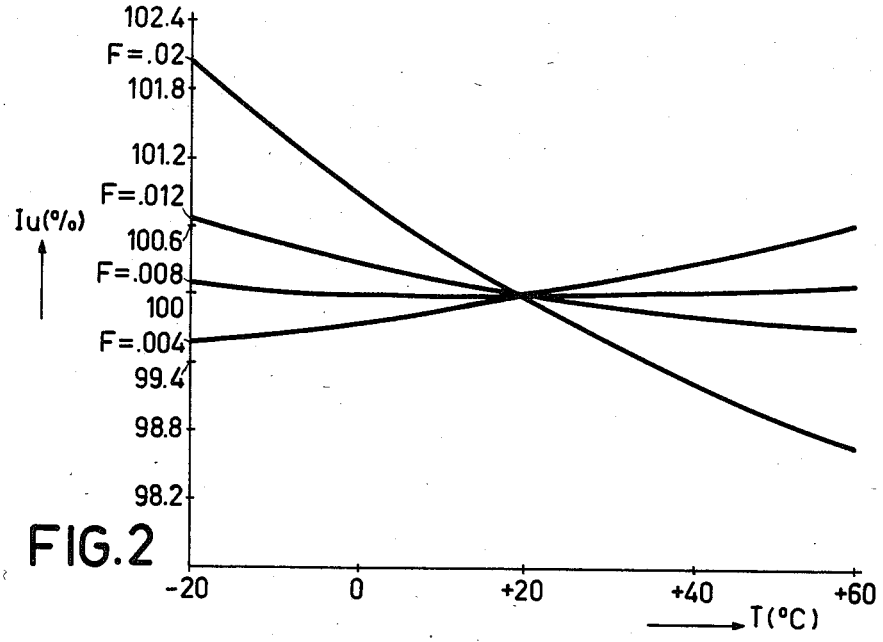
FIG. 2 shows the output current of the arrangement shown in FIG. 1 as a function of the temperature for different input voltages.

In FIG. 2 the relative output current $I_u$ of the amplifier 3 is plotted as a function of the temperature T for different values of the input voltage $V_{in} = F.E_{gap}$, the fraction F being determined by the ratio between the values of the resistors $R_7$ and $R_8$. The Figure shows that the current $I_u$ exhibits a maximum variation of 0.6% in the temperature range from −20° C. to +60° C. for comparatively small values of F (F=0.004; 0.008 and 0.012). For greater values of F (F=0.02) the output current exhibits a negative temperature-dependence, which current may alternatively be taken from terminal 8. By a suitable choice of the ratio between the values of the resistors $R_7$ and $R_8$ a substantially temperature-independent current is available on the output terminal 8 of the amplifier 3. When the circuit is integrated in an integrated FM receiver this temperature-independent current may be applied to the delay elements used for demodulation.

For the values of F for which a substantially temperature-independent output current is obtained, the input voltage of the amplifier is approximately 10 mV, which is not very high relative to the amplifier offset voltage, which is of the order of b 1 mV for customary dimensions of the transistors $T_{11}$ and $T_{12}$. In order to reduce the influence of this offset voltage, the transistors $T_{11}$ and $T_{12}$ may be provided with a plurality of emitters, so that the emitter area of these transistors is increased and the offset voltage is reduced.

Figure 3A:
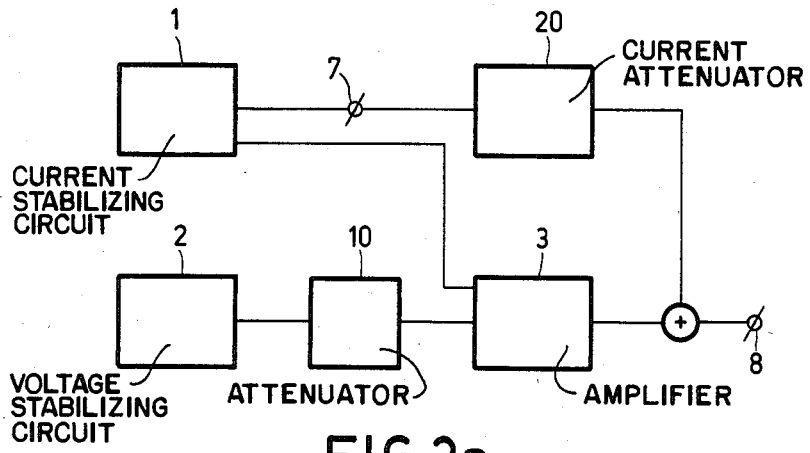
FIG. 3*a* shows a second embodiment of the invention.

Another possibility of reducing the influence of the offset voltage will be explained with reference to FIG. 3*a*, which is a block diagram of a second current source arrangement in accordance with the invention. The circuit arrangement again comprises a current-stabilizing circuit 1 which supplies a current having a positive temperature-dependence to the amplifier 3, and a voltage-stabilizing circuit 2 which supplies a temperature-independent voltage to the amplifier 3 via an attenuator 10. The influence of the offset voltage is reduced by increasing the ratio between the input and the offset voltage by increasing the fraction F by means of the resistors $R_7$ and $R_8$ (see FIG. 1). By increasing the fraction F, for example F=0.02 in the present embodiment, the output current of the amplifier 3 will have a negative temperature-dependence (see FIG. 2). By taking a current having a positive temperature-dependence from the current stabilizing circuit 1 and adding a fraction of this current to the output current of the amplifier 3 via a current attenuator 20, a substantially temperature-independent current is obtained which is available on terminal 8.

Figure 3B:
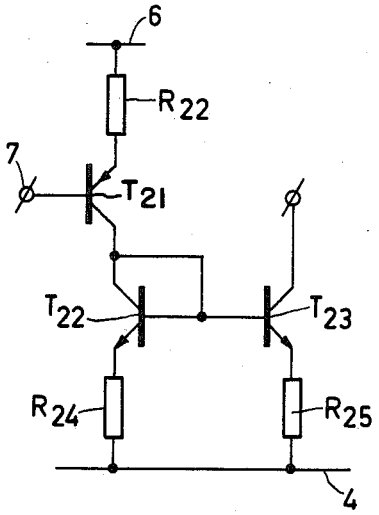
FIG. 3*b* shows a version of a current attenuator.

FIG. 3*b* shows a version of the current attenuator 20. The base electrode of a transistor $T_{21}$ is connected to the terminal 7 (see FIG. 1). The emitter of transistor $T_{21}$ is connected to the power-supply terminal 6 via a resistor $R_{22}$. The resistor $R_{22}$ has a resistance value equal to that of the resistor $R_5$, so that a current having a positive temperature-dependence flows in the collector line of the transistor $T_{21}$. This collector current is reflected by a current mirror comprising transistors $T_{22}$ and $T_{23}$, of which transistor $T_{22}$ is arranged as a diode, and the resistors $R_{24}$ and $R_{25}$. The ratio between the emitter areas of the transistors $T_{22}$ and $T_{23}$ and the ratio between the values of the resistors $R_{24}$ and $R_{25}$ is n:1 the collector current of transistor $T_{23}$ is therefore n times as small as the collector current of transistor $T_{21}$. The collector of transistor $T_{23}$ may be connected to the output 8 of the amplifier 3.

The invention is not limited to the version described for the current and voltage stabilizing circuit and the amplifier. In principle, any current and voltage stabilizer may be used which supplies a current having a positive temperature-dependence and a temperature-independent voltage. Moreover, any amplifier provided with a current output and having an input differential stage with a current source in the common emitter line may be used.

What is claimed is:

1. A temperature-compensated current source arrangement for generating an output current which is substantially temperature-independent or has a negative temperature dependence, which comprises:

a current-stabilizing circuit for generating a current having a positive temperature dependence;

a voltage-stabilizing circuit for generating a temperature-independent voltage; and an amplifier having a temperature-compensated current output terminal, said amplifier comprising first and second bipolar transistors arranged as a differential pair having a common emitter connection and two base connections, said current from said current-stabilizing circuit being coupled to said common emitter connection and at least a fraction of said voltage from said voltage-stabilizing circuit being applied between said two base connections, said current output terminal being connected to a collector of one of said transistors of the differential pair.

2. A current-source arrangement as claimed in claim 1, characterized in that the fraction of the output voltage of the voltage-stabilizing circuit has such a magnitude that the output current of the amplifier has a negative temperature-dependence, and a fraction of the current having a positive temperature-dependence derived from the current-stabilizing circuit is added to said output current such that the sum of said currents is substantially temperature-independent.

3. A current source arrangement as claimed in claim 1, or 2, characterized in that the current-stabilizing circuit and the voltage-stabilizing circuit each comprise a first and a second parallel circuit between a first and a second common terminal, which first circuit comprises the series arrangement of a first resistor, the emitter-collector path of a first transistor and a second resistor, in that order, which second circuit comprises the series arrangement of the emitter-collector path of a second transistor, whose base electrode is connected in common with that of the first transistor, and a third resistor, in that order, which second and third resistors are connected to the second common terminal which, by means of a third transistor arranged as an emitter follower, is driven by the output of a differential amplifier comprising a fourth and a fifth transistor which are arranged as a differential pair and whose base electrodes are connected to a point between the second resistor and the first transistor and to a point between the third resistor and the second transistor, respectively, the common connection of the emitters of the fourth and the fifth transistor being coupled to the common control electrodes of the first and the second transistor.

* * * * *